US012594468B2

(12) United States Patent
Kawabata et al.

(10) Patent No.: US 12,594,468 B2
(45) Date of Patent: Apr. 7, 2026

(54) GROMMET AND RACKET

(71) Applicant: YONEX CO., LTD., Tokyo (JP)

(72) Inventors: Masato Kawabata, Niigata (JP); Hitoshi Kato, Niigata (JP); Koji Nagasawa, Tokyo (JP); Nao Inoue, Tokyo (JP)

(73) Assignee: YONEX CO., LTD., Tokyo (JP)

( * ) Notice: Subject to any disclaimer, the term of this patent is extended or adjusted under 35 U.S.C. 154(b) by 705 days.

(21) Appl. No.: 17/435,225

(22) PCT Filed: Mar. 6, 2020

(86) PCT No.: PCT/JP2020/009756
§ 371 (c)(1),
(2) Date: Aug. 31, 2021

(87) PCT Pub. No.: WO2020/184452
PCT Pub. Date: Sep. 17, 2020

(65) Prior Publication Data

US 2022/0134190 A1 May 5, 2022

(30) Foreign Application Priority Data

Mar. 8, 2019 (JP) ..... 2019-042724

(51) Int. Cl.
*A63B 49/022* (2015.01)
*A63B 60/54* (2015.01)
(Continued)

(52) U.S. Cl.
CPC ..... *A63B 49/022* (2015.10); *A63B 60/54* (2015.10); *A63B 2102/02* (2015.10); *A63B 2102/04* (2015.10); *A63B 2102/06* (2015.10)

(58) Field of Classification Search
CPC . A63B 49/02; A63B 2102/02; A63B 2102/04; A63B 2102/06; A63B 60/54; A63B 49/022; A63B 51/00
See application file for complete search history.

(56) References Cited

U.S. PATENT DOCUMENTS 5,137,274 A * 8/1992 Soong ..... A63B 49/022 473/539
5,251,895 A * 10/1993 Darling ..... A63B 49/022 473/541
(Continued)

FOREIGN PATENT DOCUMENTS

CN 201370933 Y * 12/2009
GB 1278474 6/1972
(Continued)

OTHER PUBLICATIONS

Office Action issued in Corresponding JP Patent Application No. 2019-042724, dated Jan. 10, 2023, along with an English translation thereof.
(Continued)

*Primary Examiner* — Nicholas J. Weiss
*Assistant Examiner* — Amir A Klay
(74) *Attorney, Agent, or Firm* — Greenblum & Bernstein, P.L.C.

(57) ABSTRACT

Structures with racket performance varied according to the configurations of cylindrical parts can be easily used. A grommet includes a cylindrical part which is mounted pierced through a through hole formed in a frame of a racket and through which a string passes. The string is extended in a tensioned state on the frame so as to form front and back faces as hitting faces. The cylindrical part includes a first formation section forming both sides of a central axis position of the cylindrical part and a second formation section rotationally shifted with reference to the central axis
(Continued)

position by 90 degrees relative to the first formation section and forming both sides of the central axis position. One of the first and second formation sections is disposed on both sides in a front/back direction. The first and second formation sections each have a different rigidity.

5 Claims, 4 Drawing Sheets

(51) Int. Cl.

| | |
|---|---|
| ***A63B 102/02*** | (2015.01) |
| ***A63B 102/04*** | (2015.01) |
| ***A63B 102/06*** | (2015.01) |

(56) References Cited

U.S. PATENT DOCUMENTS

| | | | | |
|---|---|---|---|---|
| 5,332,213 | A | 7/1994 | Klose | |
| 5,368,297 | A * | 11/1994 | Liu | A63B 60/00 473/539 |
| 5,762,570 | A * | 6/1998 | Shaw | A63B 60/54 473/522 |
| 5,944,624 | A * | 8/1999 | Davis | A63B 49/028 473/522 |
| 6,074,315 | A * | 6/2000 | Yimoyines | A63B 51/00 473/539 |
| 6,527,656 | B1 * | 3/2003 | Cheng | A63B 49/022 473/539 |
| 6,811,502 | B1 * | 11/2004 | Janes | A63B 60/52 473/542 |
| 7,887,444 | B1 * | 2/2011 | Severa | A63B 49/022 473/539 |
| 8,834,306 | B2 * | 9/2014 | Doyle | A63B 49/022 473/522 |
| 8,951,150 | B2 | 2/2015 | Mace et al. | |
| 9,597,555 | B2 * | 3/2017 | Goto | A63B 60/42 |
| 10,384,101 | B2 * | 8/2019 | Valbousquet | A63B 49/022 |
| 10,561,907 | B2 * | 2/2020 | Yamamoto | A63B 60/48 |
| 10,729,943 | B2 * | 8/2020 | Schwenger | A63B 49/022 |
| 11,161,016 | B2 * | 11/2021 | Yamamoto | A63B 51/02 |
| 2001/0041632 | A1 * | 11/2001 | Bertolotti | A63B 49/025 473/543 |
| 2006/0172828 | A1 * | 8/2006 | Pezzato | A63B 49/022 473/527 |
| 2010/0331126 | A1 * | 12/2010 | Iizawa | A63B 49/02 473/539 |
| 2011/0165975 | A1 * | 7/2011 | Bothwell | A63B 51/00 156/185 |
| 2014/0296005 | A1 * | 10/2014 | Yamamoto | A63B 60/42 473/519 |
| 2015/0157902 | A1 * | 6/2015 | Mohr | A63B 49/022 473/539 |
| 2017/0173407 | A1 | 6/2017 | Ogawa et al. | |

FOREIGN PATENT DOCUMENTS

| | | | | |
|---|---|---|---|---|
| GB | 1278474 | A * | 6/1972 | A63B 60/00 |
| JP | 49-23864 | | 6/1974 | |
| JP | 05-076466 | | 10/1993 | |
| JP | 5-345052 | | 12/1993 | |
| JP | 2005073785 | A * | 3/2005 | |
| JP | 2012-517873 | | 8/2012 | |
| JP | 2013226298 | A * | 11/2013 | |
| JP | 2015-217192 | | 12/2015 | |
| JP | 2016221148 | A * | 12/2016 | |
| JP | 2018089153 | A * | 6/2018 | |
| WO | WO-0009219 | A1 * | 2/2000 | A63B 49/02 |
| WO | 2010/133845 | | 11/2010 | |

OTHER PUBLICATIONS

Extended European Search Report Issued in Corresponding EP Patent Application No. 20770809.0, dated Oct. 10, 2022.

International Search Report for WIPO Patent Application No. PCT/JP2020/009756, dated Apr. 28, 2020, along with an English translation thereof.

* cited by examiner

GROMMET AND RACKET

TECHNICAL FIELD

The present invention relates to a grommet to be mounted on a racket frame so as to prevent a string and the frame from being in contact with each other, and to a racket using the grommet.

BACKGROUND ART

As disclosed in patent document 1, tennis rackets and badminton rackets are provided with a loop-shaped frame and have a hitting face (a face) formed by extending a string in a tensioned state inside the frame. The frame has formed therein many holes which are arranged at certain spacings and through which the string is inserted. Grommets are mounted in the holes, and cylindrical portions of the grommets are positioned between the inner circumferential faces of the holes and the string so as to prevent the inner circumferential faces and the string from being in contact with each other.

PRIOR ART DOCUMENT

Patent Document

Patent Document 1: Japanese National Publication of International Patent Application No. 2012-517873

SUMMARY OF THE INVENTION

Problems to be Solved by the Invention

When a racket hits a ball, strings receive a force in the front/back direction of a hitting face, and the force also acts on grommets via the strings. When, for example, a ball is hit with spin, a string extended in a tensioned state in a longitudinal direction also receives a force in a lateral direction, and the force in the lateral direction also acts on the grommets. The inventors focused on the fact that forces act on the grommets like this, and has allowed structures with varied grommet rigidities to be used, thereby arriving at an invention that allows various performances of a racket to be varied.

The present invention was created in view of such a fact, and an object thereof is to provide a grommet and a racket for which structures with racket performance varied according to the configurations of cylindrical parts can be easily used.

Means for Solving Problems

A grommet in one aspect of the present invention includes a cylindrical part which is mounted pierced through a hole formed in a frame of a racket and through which a string passes, wherein the string is extended in a tensioned state on the frame so as to form front and back faces as hitting faces, the cylindrical part includes a first formation section forming both sides of a central axis position of the cylindrical part and a second formation section rotationally shifted with reference to the central axis position by 90 degrees relative to the first formation section and forming both sides of the central axis position, one of the first and second formation sections is disposed on both sides in a front/back direction, and the first and second formation sections each have a different rigidity.

This configuration allows for implementation of a structure in which the cylindrical part can be oriented in such a manner as to allow for the selecting of which of the first and second formation sections is to be disposed in the front/back direction. Thus, the rigidities of the cylindrical part in the front/back direction and in a direction orthogonal thereto can be varied, and various performances pertaining to ball hitting, such as ball repulsive-performance and spin performance, can be varied, thereby allowing structures meeting various user needs to be easily implemented.

In the grommet of the present invention, the cylindrical part, when viewed in a direction in which a central axis thereof extends, may include a circular inner edge and an oval or ellipsoidal outer edge, so as to provide the first and second formation sections. In accordance with this configuration, with the cylindrical part having a simple and non-complicated shape, the rigidity of the cylindrical part in the longer direction, in which the oval or ellipsoidal shape is formed, can be relatively enhanced, and the rigidity thereof in the shorter direction can be relatively decreased.

A racket in one aspect of the present invention includes: the grommet, which includes a plurality of the cylindrical parts; and a frame on which strings are extended in a tensioned state in a longitudinal direction and a lateral direction, the strings forming front and back faces as hitting faces, wherein the cylindrical parts are pierced through holes formed in the frame, so as to mount the grommet on the frame, and the strings are extended in a tensioned state by being passed through the plurality of cylindrical parts.

In the racket of the present invention, positions at which are formed the first and second formation sections of cylindrical parts through which the string extended in a tensioned state in the longitudinal direction is inserted may be different, by 90 degrees with reference to the central axis positions of the cylindrical parts, from positions at which are formed the first and second formation sections of cylindrical parts through which the string extended in a tensioned state in the lateral direction is inserted. In accordance with this configuration, the ball hitting performance can be obtained under a condition in which the cylindrical parts through which the string in the longitudinal direction is inserted and the cylindrical parts through which the string in the lateral direction is inserted are different from each other in terms of the orientations of the first and second formation sections.

In the racket of the present invention, the first formation sections may have a higher rigidity than the second formation sections, cylindrical parts through which the string extended in a tensioned state in the longitudinal direction is inserted may each have the first formation section formed on both sides in the front/back direction, and cylindrical parts through which the string extended in a tensioned state in the lateral direction is inserted may each have the second formation section formed on both sides in the front/back direction. In accordance with this configuration, the cylindrical parts through which the string in the longitudinal direction is inserted can have a relatively low rigidity in the lateral direction and thus have a large motion range in the lateral direction when a ball is hit, thereby allowing the string in the longitudinal direction to enhance the spin performance upon ball hitting. Moreover, the cylindrical parts through which the string in the lateral direction is inserted can have a relatively low rigidity in the front/back direction and thus have a large motion range in the front/back direction when a ball is hit, thereby allowing the string in the lateral direction to enhance the ball repulsive-performance.

In the racket of the present invention, the holes have a circular shape, and the first and second formation sections of each of the cylindrical parts may be different from each other in terms of a distance in a radial direction to an inner circumferential edge of a hole through which the cylindrical part is pierced. In accordance with this configuration, with respect to the relationship with the holes in the frame through which the cylindrical parts are pierced, each of the formation sections that desirably have a larger motion range, among the first and second formation sections, can have a large space between the formation section and the hole. Thus, the motion range of the cylindrical part can be increased not only by the first and second formation sections of the cylindrical part, but also in terms of the relationship with the hole through which the cylindrical part is pierced.

In the racket of the present invention, the first and second formation sections may be formed in each of cylindrical parts, among the plurality of cylindrical parts, through which a string extended in a tensioned state in the longitudinal and/or lateral direction and passing through a central region of the hitting faces is inserted. In accordance with this configuration, the ball hitting performance of the strings forming a so-called sweet spot can be enhanced effectively.

In the racket of the present invention, the cylindrical parts in which the first and second formation sections are formed may protrude from an inner circumferential face of the frame by a smaller amount than the cylindrical parts in which the first and second formation sections are not formed. In accordance with this configuration, owing to the cylindrical parts with a small amount of protrusion, a large motion range can be enhanced for the string inserted through these cylindrical parts.

Effect of the Invention

In the present invention, the cylindrical parts are, as described above, provided with the first and second formation sections having different rigidities, thereby allowing the structure enhancing the racket performance to be easily used.

Figures 1A, 1B:
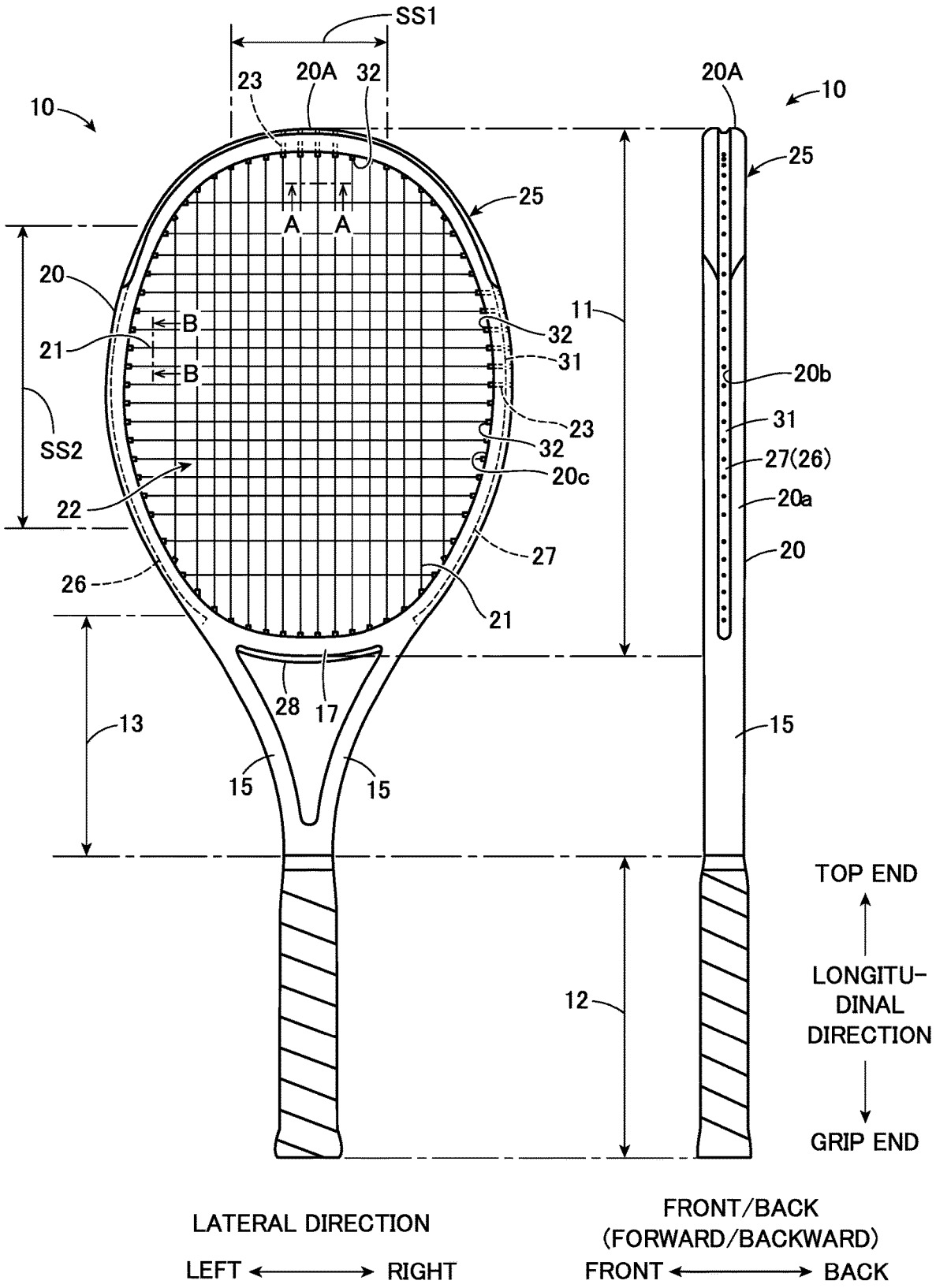
FIGS. 1A and 1B are appearance views of a racket in accordance with embodiments, FIG. 1A being a front view of the racket, FIG. 1B being a side view of the racket.

The following specifically describes embodiments of the present invention by referring to the drawings. Although the following descriptions are given for examples in which the grommet of the present invention is applied to a soft tennis racket, the application of the grommet is not limited to this and can be changed. For example, the grommet may be applied to a tennis racket, a squash racket, or a badminton racket.

FIG. 1 is an appearance view of a racket in accordance with embodiments of the present invention, FIG. 1A being a front view of the racket, FIG. 1B being a side view of the racket. Note that indications of some components are omitted for descriptive purposes in the drawings described in the following.

As depicted in FIG. 1, a racket 10 includes: a head 11, i.e., a site for hitting a ball; a grip 12, i.e., a site to be gripped by a player to hold the racket 10; and a shaft 13 integrally coupling the head 11 and the grip 12. In the following descriptions, as indicated by arrows in FIG. 1, the longer direction of the racket 10 is defined as a longitudinal direction, the side in the longitudinal direction on which the head 11 is located is defined as a top-end side, and the side in the longitudinal direction on which the grip 12 is located is defined as a grip-end side. A direction orthogonal to the longitudinal direction on a hitting face 22 of the racket 10 (i.e., on a plane along the hitting face 22) is defined as a lateral direction (or a left-right direction). A direction orthogonal to the hitting face 22 of the racket 10 is defined as a front/back direction (or a forward/backward direction). The near side of the plane of FIG. 1A (left side of the plane of FIG. 1B) is defined as a front side, and the opposite side from the front side is defined as a back side.

When seen in the forward/backward direction, the shaft 13 includes throats 15 constituted by two branches extending from the grip 12 toward the head 11. A yoke 17 forming a portion of the head 11 is formed between the left and right throats 15. The shaft 13 is not limited to this and may not include two branches.

The head 11 includes an oval frame 20 that is long in the longitudinal direction, and strings 21 that are extended inside the frame 20 in a tensioned state in the longitudinal direction and the lateral direction. The strings 21 form hitting faces (faces) 22 on both of the front and back sides of the inside of the frame 20. For example, the frame 20 may be provided by forming a cylindrical hollow body formed from fiber-reinforced plastic into an oval shape. Alternatively, the frame 20 may not be a hollow body but may be filled with a foam material, or may be a wooden or metal body.

An outer peripheral face 20*a* of the frame 20 includes a groove section 20*b* formed by a central portion of the outer peripheral face 20*a* in the thickness direction being recessed relative to both side portions thereof. The groove section 20*b* is continuously provided in the circumferential direction of the frame 20. The frame 20 includes through holes (holes) 23. The through holes 23 extend in a pierced manner from the bottom side of the groove section 20*b* of the frame 20 to an inner circumferential face 20*c* of the frame 20. The through holes 23, i.e., a plurality of through holes, are arranged in the circumferential direction of the frame 20.

Figure 2:
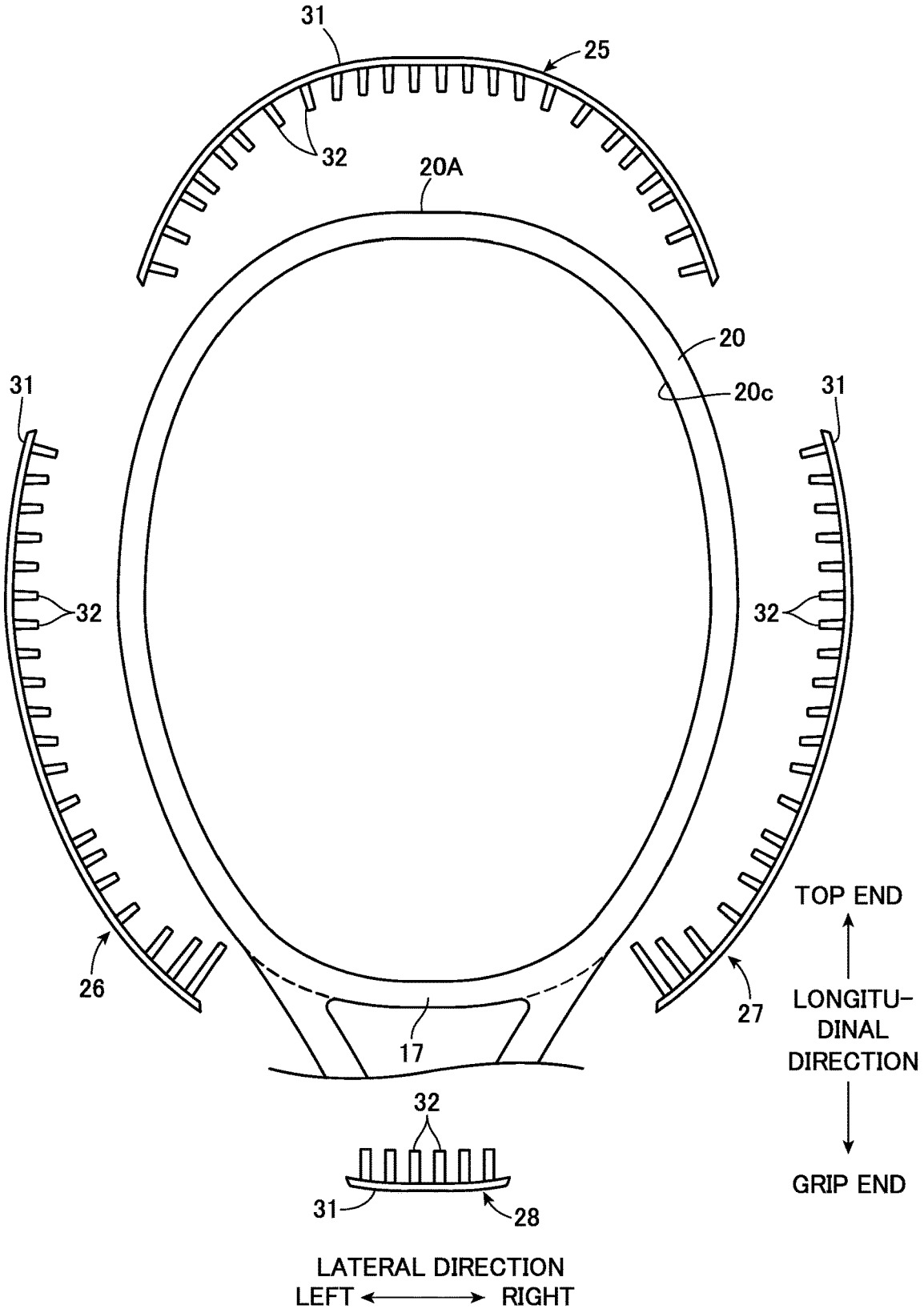
FIG. 2 is an explanatory front view of a situation in which grommets have been removed from a frame.

FIG. 2 is an explanatory front view of a situation in which grommets have been removed from the frame. Four grommets 25-28 are mounted, as indicated in FIG. 2, onto the frame 20 from the outer-edge side, and strings 21 are extended in a tensioned state on the frame 20 via the grommets 25-28. In the present embodiment, the grommet 25 on the top-end side extends, with reference to the front view of the frame 20 in FIG. 2, from a site of approximately 10 o'clock to a site of approximately 2 o'clock and protects the portion of the frame 20 on a top-20A side. The left and right grommets 26 and 27 are respectively provided extending from the vicinities of the left and right end portions of the grommet 25 on the top-end side to positions reaching the lowermost through holes 23 formed in the left and right side faces of the frame 20. The grommet 28 on the grip-end side is provided on the yoke 17. The lengths of the grommets 25-27, i.e., the grommets other than the grommet 28 on the grip-end side, in the circumferential direction of the frame 20 may be varied in accordance with various conditions.

As an example, the grommets 25-28 may each be a molded product obtained through injection molding with thermoplastic. The grommets 25-28 each include a band-like part 31 extending in the circumferential direction of the frame 20 and a plurality of cylindrical parts 32 protruding from a back face of the band-like part 31, i.e., one face of the band-like part 31. The band-like part 31 has a forward-backward width that is greater than or equal to that of the groove section 20*b* and less than that of the frame 20. The band-like part 31 of the grommet 25 on the top-end side has a forward-backward width substantially equal to that of the frame 20 and protects the top-20A side of the frame 20.

The cylindrical parts 32 each include a base section on the band-like-part-31 side and a leading-end section on an opposite side from the base section, and the leading-end sections are pierced through the through holes 23 from outside the frame 20. The piercing causes the grommets 25-28 to be mounted on the frame 20, with the leading-end sides of the cylindrical parts 32 disposed protruding inward from the inner-circumferential-face-20*c* side of the frame 20. An inner space of each of the cylindrical parts 32 is formed as an insertion path 33 (see FIG. 3) through which a string 21 is inserted. The inner diameter of the insertion path 33 is substantially the same as or slightly larger than the diameter of the string 21, i.e., the inner diameter of the insertion path 33 is made to be closer to that of the string 21 to be suppressed from being displaced relative to the insertion path 33 when a ball is hit. The inner diameter of the insertion path 33 is within a range from 100 to 165, where the diameter of the string 21 is 100.

Figure 3A:
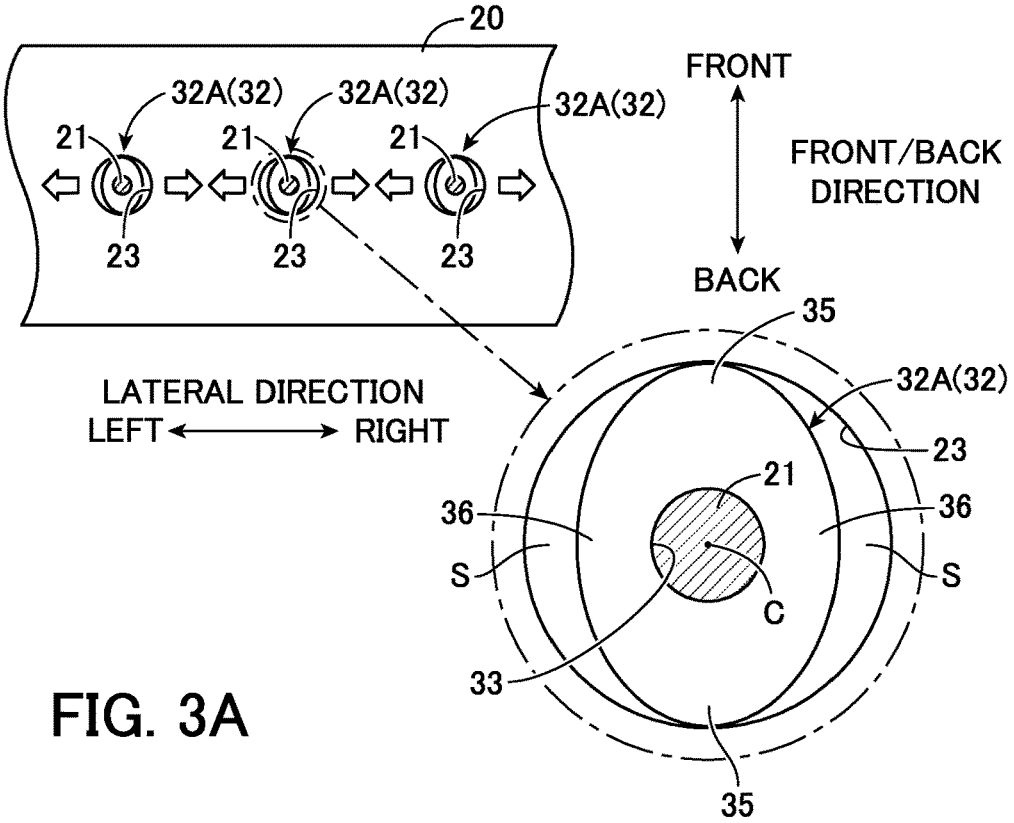
FIG. 3A is an A-A line cross-sectional view of FIG. 1A.
Figure 3B:
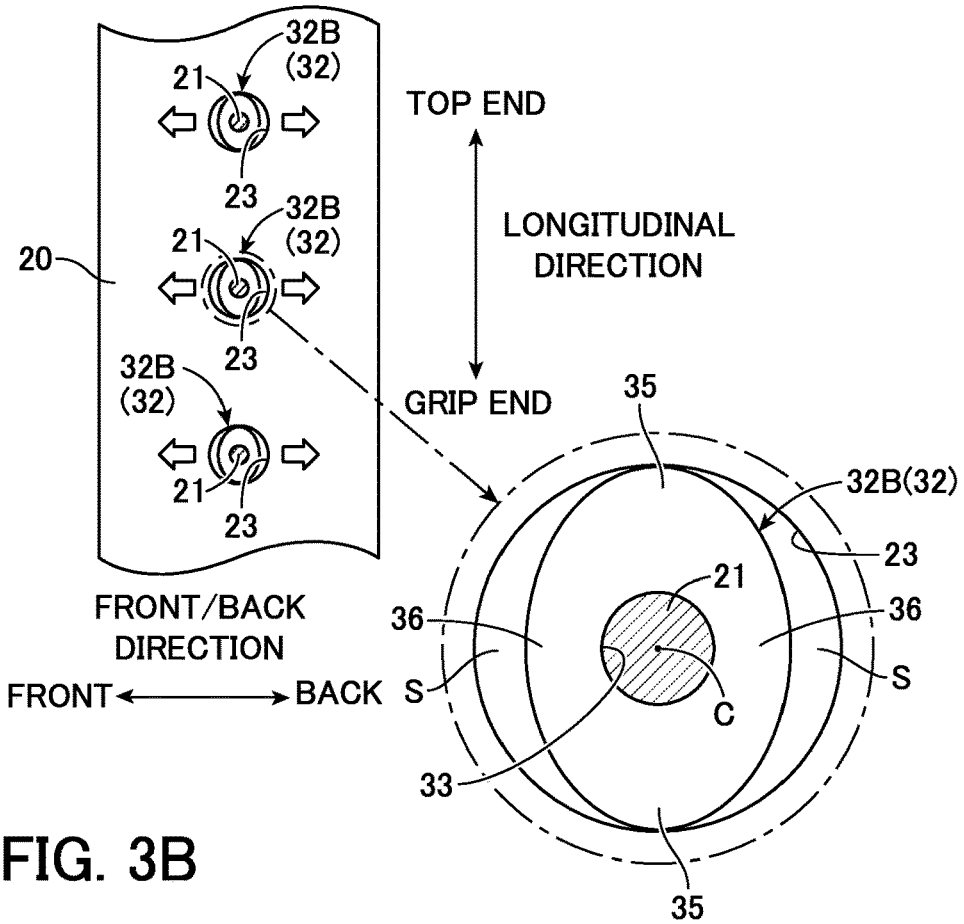
FIG. 3B is a B-B line cross-sectional view of FIG. 1A.

Next, the specific configuration of the cylindrical part is described by referring to FIG. 3. FIG. 3A is an A-A line cross-sectional view of FIG. 1. FIG. 3B is a B-B line cross-sectional view of FIG. 1. FIG. 3A represents a cylindrical part 32 through which a string 21 extended in a tensioned state in the longitudinal direction is inserted (hereinafter, "longitudinal cylindrical part 32A"). FIG. 3B represents a cylindrical part 32 through which a string 21 extended in a tensioned state in the lateral direction is inserted (hereinafter, "lateral cylindrical part 32B").

FIGS. 3A and 3B are seen in the direction in which the central axis of the string 21 extends (a direction orthogonal to the plane of the figures). As depicted in FIGS. 3A and 3B, the longitudinal cylindrical part 32A and the lateral cylindrical part 32B each include a circular inner edge forming an insertion path 33 and an oval outer edge, and the inner edge and the outer edge share the same central axis position C. The longitudinal cylindrical part 32A and the lateral cylindrical part 32B each include a first formation section 35 forming, in a major axis direction, both sides of the central axis position C, and a second formation section 36 forming, in a minor axis direction, both sides of the central axis C. Thus, the second formation section 36 is positioned rotationally shifted with reference to the central axis position C by 90 degrees relative to the first formation section 35.

The first formation section 35 is a certain region including the major axis of the oval, and the second formation section 36 is a certain region including the minor axis of the oval. Accordingly, in each of the longitudinal cylindrical part 32A and the lateral cylindrical part 32B, the first formation section 35 has a different thickness from the second formation section 36 and thus has a different rigidity from the second formation section 36. In the present embodiment, the first formation section 35 has a higher rigidity than the second formation section 36. As an example, the certain regions may be regions depending on the diameter of the insertion path 33 or regions within a range of about 90 degrees with reference to the central axis position C with the major axis and the minor axis as centers.

The positions at which the first formation section 35 and the second formation section 36 of the longitudinal cylindrical part 32A are formed are different, by 90 degrees with reference to the central axis positions C, from the positions at which the first formation section 35 and the second formation section 36 of the lateral cylindrical part 32B are formed. In particular, in the longitudinal cylindrical part 32A in FIG. 3A, the first formation section 35 is formed on both sides in the front/back direction, and the second formation section 36 is formed on both sides in a direction orthogonal to the front/back direction with reference to the face direction of the hitting face 22 (see FIG. 1), i.e., both sides in the lateral direction. In the lateral cylindrical part 32B in FIG. 3B, by contrast, the second formation section 36 is formed on both sides in the front/back direction, and the first formation section 35 is formed on both sides in a direction orthogonal to the front/back direction with reference to the face direction of the hitting face 22, i.e., both sides in the longitudinal direction.

The through holes 23 formed in the frame 20 are circular openings (openings shaped like exact circles), and the longitudinal cylindrical parts 32A and the lateral cylindrical parts 32B that have oval outer edges are mounted into the circular through holes 23 by being pierced therethrough. Accordingly, the first formation section 35 formed on both sides in the major axis direction of the oval and the second formation section 36 formed on both sides in the minor axis direction of the oval are different from each other in terms of the distance in the radial direction to the inner circumferential edge of the through hole 23. In particular, spaces S are formed between the second formation sections 36 and the inner circumferential edges of the through holes 23, thereby forming deformation allowances allowing the cylindrical parts 32A and 32B to be deformed in directions such that the cylindrical parts 32A and 32B tilt toward the spaces S (see the white arrows in the figures). Meanwhile, the first formation sections 35 and the inner circumferential edges of the through holes 23 contact each other or have small spaces therebetween, and the inner circumferential edge of each of the through holes 23 restricts deformation that would occur when the cylindrical parts 32A and 32B tilt toward the first formation section 35.

The longitudinal cylindrical part 32A and the lateral cylindrical part 32B are, as described above, different in terms of the positions at which the first formation section 35 and the second formation section 36 are formed, and thus each have a different position (orientation) for formation of the space S. In particular, in the lateral cylindrical part 32B in FIG. 3B, spaces S are formed on both sides in the front/back direction, and in the longitudinal cylindrical part 32A in FIG. 3A, spaces S are formed on both sides in a direction orthogonal to the face direction of the hitting face 22 (both sides in the lateral direction), in comparison with the front/back direction.

Figure 4:
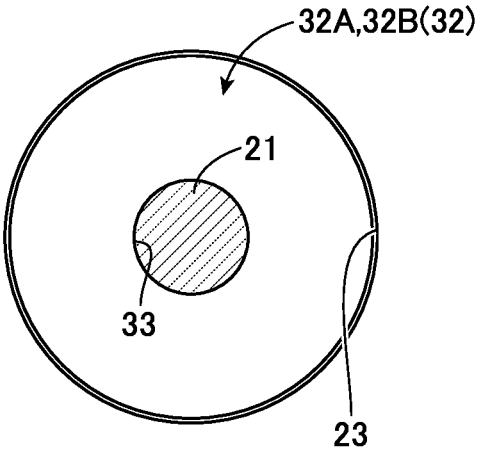
FIG. 4 is an explanatory cross-sectional view exemplifying a cylindrical part.

Although every longitudinal cylindrical part 32A and every lateral cylindrical part 32B may include a first formation section 35 and a second formation section 36, some of the longitudinal cylindrical parts 32A and the lateral cylindrical parts 32B may have a circular outer edge shape so as to attain a uniform thickness in the circumferential direction (see FIG. 4). For example, the longitudinal cylindrical parts 32A and the lateral cylindrical parts 32B, through which the string 21 that passes through the central region of the hitting face 22, which is so-called a sweet spot, is inserted, may include first formation sections 35 and second formation sections 36. In particular, the longitudinal cylindrical parts 32A within a region SS1 in FIG. 1 and the lateral cylindrical parts 32B within a region SS2 in FIG. 1 may include first formation sections 35 and second formation sections 36.

The longitudinal cylindrical parts 32A and the lateral cylindrical parts 32B that include first formation sections 35 and second formation sections 36 may protrude from the inner circumferential face 20*c* of the frame 20 by a smaller amount than the longitudinal cylindrical parts 32A and the lateral cylindrical part 32B without first formation sections 35 and second formation sections 36. In this case, the string 21 inserted into the cylindrical parts 32A and 32B that include first formation sections 35 and second formation sections 36 tends to be more easily flexure-deformed when hitting a ball.

When a ball is hit with spin by the racket 10, the string 21 extended in a tensioned state in the longitudinal direction is flexed by receiving a force in the lateral direction, and spin is applied to the ball owing to the force of the string 21 restoring from the flexed state. In the longitudinal cylindrical part 32A, as described above, the second formation section 36 is formed on both sides in the lateral direction and has a lower rigidity than the first formation section 35, so the amount of motion (deformation) of the longitudinal cylindrical part 32A in the lateral direction can be increased (see FIG. 3A), thereby increasing the elastic force of the longitudinal cylindrical part 32A in the lateral direction when the longitudinal cylindrical part 32A is restored after being moved. Hence, the spin rate of a ball can be increased so that the spin performance in ball hitting can be enhanced.

When a ball is hit by the racket 10, the string 21 receives a force in the front/back direction and is flexed in the front/back direction, and the ball is repulsively hit by receiving the force of the string 21 restoring from the flexed state. When the lateral cylindrical part 32B is configured such that, as described above, a second formation section 36 is formed on both sides in the front/back direction and has a lower rigidity than a first formation section 35, the amount of motion (deformation) of the lateral cylindrical part 32B in the front/back direction can be increased, thereby increasing the elastic force of the lateral cylindrical part 32B in the front/back direction when the lateral cylindrical part 32B is restored after being moved. Hence, the repulsive force applied to the ball can be increased so that the ball repulsive-performance can be enhanced.

The longitudinal cylindrical part 32A includes a first formation section 35 having a high rigidity and formed on both sides in the front/back direction, so when attention is focused only on the string 21 extended in a tensioned state in the longitudinal direction, it may seem as if the longitudinal cylindrical part 32A does not tend to be deformed in the front/back direction and decreases the repulsive-performance. However, since the string in the longitudinal direction in the racket 10 is longer than that in the lateral direction, the string 21 extended in a tensioned state in the lateral direction, which is relatively short, more largely affects the repulsive-performance. The lateral cylindrical parts 32B, and thus the string 21 in the lateral direction, have a large amount of motion, so the amount of motion of the longitudinal string 21 and that of the lateral string 21 can be made close to each other so as to increase the amount of flexure deformation of the entirety of the strings 21, thereby enlarging the sweet spot with the repulsive-performance enhanced. In one possible configuration, material for the longitudinal cylindrical part 32A may be different from that for the lateral cylindrical part 32B such that the lateral cylindrical part 32B is more flexible (deformable) than the longitudinal cylindrical part 32A. In accordance with this configuration, the lateral cylindrical part 32B and the string 21 in the lateral direction can have an even larger amount of motion, and the amount of motion of the longitudinal string 21 can be made even closer to that of the lateral string 21, thereby enlarging the sweet spot with the repulsive-performance enhanced.

In the present embodiment, as described above, a structure can be easily implemented in which the longitudinal cylindrical part 32A and the lateral cylindrical part 32B are different in terms of the orientations of formation sections 35 and 36 having different rigidities. Thus, the formation sections 35 and 36 having different amounts of motion (deformation) for ball hitting can be disposed as described above so as to enhance both the repulsive-performance and the spin performance.

In the meantime, structures from the prior art adopt configurations in which the area of the opening of the insertion path in a cylindrical part is large relative to a string so as to increase the amount of motion of the string. In such configurations, however, when the string is flexed upon hitting a ball, the string is displaced within the insertion path and less likely to receive a force from the cylindrical part.

In this regard, in the present embodiment, the diameter of the string 21 is made close to the inner diameter of the insertion path 33, so the cylindrical part 32 is deformed in accordance with flexure of the string 21 upon ball hitting. Thus, the force of the cylindrical part 32 restoring from a deformed state resulting from ball hitting can act on the string 21, and thus on the ball, so that the ball hitting performance can be enhanced in comparison with the structures from the prior art. In addition, when a ball is hit, displacement of the string 21 relative to the insertion path 33 can be suppressed, and unnecessary vibrations, which would be unpleasant for the player, can be prevented from being generated, so the unclear feeling of ball hitting can be avoided.

In such an embodiment, the first formation section 35 and the second formation section 36 are formed with the cylindrical part 32 having an oval outer edge, so the rigidities of the first formation section 35 and the second formation section 36 can be varied by means of the simple and non-complicated shape, thereby achieving the above-described ball hitting performance. Moreover, a configuration can be easily used in which the longitudinal cylindrical part 32A and the lateral cylindrical part 32B are different in terms of the orientations of a first formation section 35 and a second formation section 36 in the front/back direction.

Since the outer edge of the cylindrical part 32 has an oval shape, spaces S can be formed between the through hole 23 and the second formation section 36 forming both sides in the minor axis direction, with the cylindrical part 32 inserted into the circular through hole 23. The cylindrical part 32 can be easily moved (deformed) in a direction such that the cylindrical part 32 leans toward the second formation section 36 having a low rigidity, and the above-described ball hitting performance can be better achieved by the spaces S ensuring larger motion ranges for the cylindrical part 32 toward the spaces S.

The present invention is not limited to the embodiments described above and can be implemented with various changes made thereto. The above-described embodiments are not limited to the sizes, shapes, directions, or the like illustrated in the attached drawings and can have changes made thereto, as appropriate, as long as the effect of the invention can be achieved. In addition, the invention can be implemented with changes made thereto, as appropriate, without deviating from the scope of the purpose of the invention.

For example, the orientations of the first formation sections 35 and the second formation sections 36 in the longitudinal cylindrical part 32A and the lateral cylindrical part 32B are not limited to the abovementioned ones, and in comparison with the abovementioned embodiments, the orientations of the first formation section(s) 35 and the second formation section(s) 36 of both/either the longitudinal cylindrical part 32A and/or the lateral cylindrical part 32B may be shifted by 90 degrees with reference to the central axis position C. Meanwhile, the second formation section 36 may have a higher rigidity than that of the first formation section 35. Thus, although, for example, the spin performance or the repulsive-performance provided by the cylindrical parts 32A and 32B could be reduced, the racket 10 can be implemented with a structure achieving a balanced overall performance owing to the ball hitting performance associated with, for example, the structures of, or the materials for, the frame 20 and the shaft 13. In the present invention, as described above, a structure can be implemented in which the cylindrical parts 32A and 32B can be oriented in such a manner as to allow for the selecting which of the first formation section 35 and the second formation section 36 is to be disposed in the front/back direction, thereby producing the racket 10 that can meet various user needs.

In the embodiments described above, the cylindrical part 32 has an oval outer edge. However, the first formation section 35 and the second formation section 36 can also be formed in the manner described above by making it so that the cylindrical part 32 has an ellipsoidal outer shape.

The first formation section 35 and the second formation section 36 of the cylindrical part 32 may have the same thickness but may each have a different rigidity by each being formed from a different material. In this case, the opening of the through hole 23 through which the cylindrical part 32 is pierced may have an oval or ellipsoidal shape such that the first formation section 35 and the second formation section 36 each have a different distance to the inner circumferential edge of the through hole 23 in the radial direction.

INDUSTRIAL APPLICABILITY

The present invention pertains to a grommet and a racket using the same, for which structures with racket performance varied according to the configurations of the cylindrical parts can be easily used.

The present application is based upon Japanese Patent Application No. 2019-042724, filed on Mar. 8, 2019, the entire contents of which are incorporated herein.

The invention claimed is:

1. A racket comprising:

a frame on which strings are extended in a tensioned state in a longitudinal direction and a lateral direction, the strings forming front and back faces as hitting faces; and a plurality of grommets provided at separate positions around the frame, each grommet including a plurality of cylindrical parts, each of the plurality of cylindrical parts is mounted by piercing through a corresponding hole, of a plurality of holes, formed in the frame and through which one of the strings passes, wherein each of the plurality of cylindrical parts includes:

a first formation section forming both sides of a central axis position of each of the plurality of cylindrical parts, and a second formation section rotationally shifted with reference to the central axis position by 90 degrees relative to the first formation section and forming both sides of the central axis position, one of the first and second formation sections is disposed on both sides in a front/back direction that is orthogonal to the hitting faces, the first and second formation sections each have a different rigidity, each of the holes, of the plurality of holes, has a circular shape, and a distance in a radial direction from the first formation section of each of the plurality of cylindrical parts to an inner circumferential edge of the corresponding hole through which each of the plurality of cylindrical parts is pierced is shorter than a distance from the second formation section to the inner circumferential edge of the corresponding hole such that a space is provided between the second formation section and the inner circumferential edge of the corresponding hole, wherein a first grommet, of the plurality of grommets, has at least a first cylindrical part, of the plurality of cylindrical parts, through which a first string of the strings extended in a tensioned state in the longitudinal direction is inserted and having a first portion at which is formed the first formation section and a second portion at which is formed the second formation section, a second grommet, of the plurality of grommets, has at least a second cylindrical part, of the plurality of cylindrical parts, through which a second string of the strings extended in a tensioned state in the lateral direction is inserted and having a first portion at which is formed the first formation section and a second portion at which is formed the second formation section, the both sides of the central axis position formed by the first formation section of the first portion of the first cylindrical part are formed in the front/back direction and the both sides of the central axis position formed by the second formation section of the second portion of the first cylindrical part are formed in a first direction orthogonal to the front/back direction, and the both sides of the central axis position formed by the first formation section of the first portion of the second cylindrical part are formed in a second direction orthogonal to the front/back direction and the both sides of the central axis position formed by the second formation section of the second portion of the second cylindrical part are formed in the front/back direction.

2. The racket of claim 1, wherein each of the plurality of cylindrical parts, when viewed in a direction in which a central axis at the central axis position thereof extends, includes a circular inner edge and an oval or ellipsoidal outer edge, so as to provide the first and second formation sections.

3. The racket of claim 1, wherein the first formation section has a higher rigidity than the second formation section.

4. The racket of claim 1, wherein the one of the strings is extended in the tensioned state in the longitudinal and/or lateral direction and passes through a central region of the hitting faces.

5. The racket of claim 4, wherein the first grommet and the second grommet each further include a plurality of cylindrical parts in which the first and second formation sections are not formed, and the plurality of cylindrical parts in which the first and second formation sections are formed protrude from an inner circumferential face of the frame toward a center of the frame less than the plurality of cylindrical parts in which the first and second formation sections are not formed.

* * * * *